US011203850B2

(12) United States Patent
Heindl

(10) Patent No.: US 11,203,850 B2
(45) Date of Patent: Dec. 21, 2021

(54) CONNECTING ELEMENT FOR LARSSEN-SHEET PILES

(71) Applicant: Richard Heindl, Gräfelfing (DE)

(72) Inventor: Richard Heindl, Gräfelfing (DE)

( * ) Notice: Subject to any disclaimer, the term of this patent is extended or adjusted under 35 U.S.C. 154(b) by 0 days.

(21) Appl. No.: 16/641,079

(22) PCT Filed: Aug. 17, 2018

(86) PCT No.: PCT/EP2018/072311

§ 371 (c)(1),
(2) Date: Feb. 21, 2020

(87) PCT Pub. No.: WO2019/038196

PCT Pub. Date: Feb. 28, 2019

(65) Prior Publication Data

US 2020/0173131 A1 Jun. 4, 2020

(30) Foreign Application Priority Data

Aug. 21, 2017 (DE) ..... 10 2017 007 798.3

(51) Int. Cl.
*E02D 5/08* (2006.01)

(52) U.S. Cl.
CPC ..... *E02D 5/08* (2013.01); *E02D 2600/20* (2013.01)

(58) Field of Classification Search
CPC combination set(s) only.
See application file for complete search history.

(56) References Cited

U.S. PATENT DOCUMENTS 1,032,109 A * 7/1912 Buckingham ..... E02D 5/08 405/279

2009/0311052 A1 12/2009 Heindl

FOREIGN PATENT DOCUMENTS

DE 20300961 U1 4/2003
EP 1939359 A1 7/2008

(Continued)

OTHER PUBLICATIONS

International Search Report and Written Opinion in PCT/EP2018/072311, dated Nov. 14, 2018. 12 pages.

*Primary Examiner* — Kyle Armstrong
(74) *Attorney, Agent, or Firm* — Meunier Carlin & Curfman LLC

(57) ABSTRACT

The invention relates to a profiled connection section with a constant cross-section for coupling at least two Larssen sheet piles (Sx, Sy, Sz) at an angle of 90°, comprising two identically designed hooked strips (12, 14; 42, 44, 46; 62, 64, 66; 82, 84; 102; 104; 106). Each hooked strip (12, 14; 42, 44, 46; 62, 64, 66; 82, 84; 102; 104; 106) has a hook-shaped hook section (16), a lock base (18, 24; 50; 68, 70; 88; 110) which adjoins one end of the hook section (16) and runs in a straight manner, and a stop (20, 26, 48, 52; 72, 74; 86, 90; 108) which adjoins the lock base perpendicularly to the lock base (18, 24; 50; 68, 70; 88; 110). The free end of the hook section (16) together with the stop (20, 26; 48, 52; 72, 74; 86, 90; 108) forms a lock jaw (24, 28; 54; 92) for hanging the sheet pile lock of the Larssen sheet pile (Sx, Sy, Sz), and when viewed in a cross-sectional direction, each hooked strip (12, 14; 42, 44, 46; 62, 64, 66; 82, 84; 102; 104; 106) has an imaginary anchor point (A, B, C) on which the main contact point of the lock profile of the sheet pile (Sx, Sy, Sz) is arranged in an ideal assembly position. According to the invention, the anchor point (A, B, C) of each hooked strip (12, 14; 42, 44, 46; 62, 64, 66; 82, 84; 102; 104; 106) has a specified distance (Ay, Bxz, Cy) which is normal to the main direction (X; Y; Z) of the Larssen sheet pile (Sx, Sy, Sz) hung on the respective other hooked strip (12, 14; 42, 44, 46; 62, 64, 66; 82, 84; 102; 104; 106) in the ideal assembly position, wherein the distances between the anchor points (A, B, C) normal to the main directions (X, Y, C) of the Larssen sheet piles (Sx, Sy, Sz) hung on the hooked strips (Continued)

(12, 14; 42, 44, 46; 62, 64, 66; 82, 84; 102; 104; 106) in the ideal assembly position are identical.

13 Claims, 7 Drawing Sheets

(56) References Cited

FOREIGN PATENT DOCUMENTS

| | | | |
|---|---|---|---|
| FR | 1588237 | A1 | 4/1970 |
| WO | 0028157 | A1 | 5/2000 |

* cited by examiner

CONNECTING ELEMENT FOR LARSSEN-SHEET PILES

CROSS REFERENCE TO RELATED APPLICATIONS

This application claims priority to and is a United States National Phase Patent Application of International Patent Application Number PCT/EP2018/072311, filed on Aug. 17, 2018, which claims priority to German Patent Application No. 10 2017 007 798.3, filed on Aug. 21, 2017, both of which are incorporated by reference herein.

The invention relates to a profiled connection section with a constant cross-section for coupling at least two Larssen sheet piles at an angle of 90°, comprising two identically configured hooked strips, wherein each hooked strip has a hook-shaped hook section, a lock base, which adjoins one end of the hook section and runs in a straight manner, and a stop, which adjoins the lock base perpendicularly to the lock base, wherein the free end of the hook section together with the stop form a lock jaw for hanging the sheet pile lock of the Larssen sheet pile, and wherein, when viewed in a cross-sectional direction, each hooked strip has an imaginary anchor point on which the main contact point of the lock profile of the sheet pile is arranged, when it is in an ideal assembly position.

Larssen sheet piles are currently the most commonly used sheet piling worldwide. They are used for erecting sheet piling walls and so-called combination walls; i.e., arrangements made of T-beams and sheet piling. Often it is also necessary to create corners having right angles in sheet piling walls. Profiled connection sections of the kind as described in the introduction are commonly used for this purpose.

Furthermore, Larssen sheet piles are also used for erecting so-called sheet pile boxes. Sheet pile boxes are closed arrangements made of a plurality of sheet piles and/or sheeting pile sections which are connected to each other at their ends by means of profiled connection sections of the type as mentioned in the introduction, and they gird an enclosed area.

Particularly when erecting sheet pile boxes of this type, the problem arises that the sheet piles cannot be lowered into the ground precisely aligned relative to each other. Although known profiled connection sections can accommodate a certain measure of deviation, said profiled connection sections are configured in such a way that they in fact complicate the precise erection of sheet pile boxes in that even small deviations cause problems when placing the sheet piles. These deviations result in problems because, due to their special lock shape, Larssen sheet piles tend to tilt when being lowered into the ground.

The prior art teaches profiled connection sections for erecting sheet piling arrangements that couple Larssen sheet piles with their main directions of extension arranged at 90° angles in relation to each other. However, known profiled connection section are designed in such a way that they in fact complicate the precise and dimensionally correct erection of sheet pile boxes.

To ensure that the lock profiles of the Larssen sheet piles can be coupled to the profiled connection section, an imaginary anchor point is commonly defined on the holding strip of the profiled connection section, seen in the cross-sectional direction, where the sheet pile, if arranged in the ideal assembly position, is arranged by its main contract point of its lock profile.

It is the object of the present invention to describe a profiled connection section that is suitable for perpendicularly coupling Larssen sheet piles to each other quickly and easily, particularly while erecting sheet pile boxes.

According to the invention, the object is achieved by providing that the anchor point of each hooked strip is arranged at a specified distance which is normal to the main direction of the Larssen sheet pile that is hung on the respective other hooked strip in the ideal assembly position and that the distances between the anchor points, normal to the main direction of the Larssen sheet pile hung on the hooked strips in the ideal assembly, are identical.

The profiled connection section according to the invention provides that the two Larsen sheet piles are coupled to each other at a specified distance relative to each other by means of the profiled connection section. By choosing the anchor points on the hooked strips in such a way that the distances, which are normal to the main direction of the sheet pile that is hung on the respective other hooked strip, are identical, it is possible to erect sheet pile boxes with sheet piles that are unrestricted and that can always be lowered into the ground being properly aligned in relation to each other. Minor deviations are no longer important because, due to the existing tolerances, they can be compensated at any time. Moreover, Larssen sheet piles from different manufacturers can be easily coupled with the aid of the profiled connection section.

Further advantages are specified in the description, the dependent claims and the drawings below.

According to a particularly preferred embodiment of the profiled connection section according to the invention, the two hooked strips that extend mirror-symmetrically are connected to each other by the ends of their stops. In addition, a support strip is provided between the lock jaws facing each other, which extends centered between the two lock jaws, starting from the connection section between the two stops and facing outward. The profiled connection section that is configured in this way is used for perpendicularly connecting two Larssen sheet piles whose lock profiles are each directly outward. The profiled connection profile is then placed from the outside onto the lock profile and encompasses the two lock profiles when the profiled connection section is being driven and/or has been driven into its final assembly position. The centrally arranged support strip therein simultaneously supports the lock profiles of the Larssen sheet piles and prevents them from coming into contact with each other.

According to an alternative improvement of the profiled connection section according to the invention, the end of the stop of the one hooked strip merges with the outside of the other hooked strip at the location of the transition of the lock base thereof. The lock jaw of the one hooked strip therein is adjacently arranged relative to the outside of the lock base of the other hooked strip, while the stop of the other hooked strip juts out at a right angle from the transition of the stop of the one hooked strip with the other hooked strip and protrudes, when viewed in a cross-sectional direction, from the end of the hooked section that is arranged on the opposite side. The profiled connection section that is configured in this way is used for perpendicularly connecting two sheet plies, where the lock profile of the one sheet pile is directed outward while the lock profile of the other sheet pile is directed inward.

It may be necessary to couple three sheet piles to each other, wherein at least one of the sheet piles extends at a right angle relative to the other sheet piles. Even here, however, it is guaranteed that the distances of the anchor points, normal to the main direction of each perpendicularly extending sheet pile, are always identical in order to achieve the desired symmetrical arrangement of the sheet piles in relation to each other.

For this purpose. a particularly preferred embodiment of the profiled connection section according to the invention provides for a further hooked strip on the profiled connection section that is identically configured relative to the other two hooked strips and serves for hanging a third Larssen sheet pile whose main direction extends at an angle of 90° relative to the other two Larssen sheet piles when it is in the ideal assembly position, and whose anchor point has a distance normal to the Larssen sheet pile extending at an angle of 90° that corresponds to the other two distances.

For the basic form of the profiled connection section, where the two hooked strips that extend mirror-symmetrically are connected to each other by the ends of their stops, it is proposed that the further hooked strip be envisioned as having its outside adjoining the outside of the hooked strip into which the Larssen sheet pile that extends at an angle of 90° is to be hung. The two hooked strips merge therein at their transitions of their lock bases with their stops in such a manner that the two hooked strips extend mirror-symmetrically with their hooked sections and their lock bases relative to each other. Using this embodiment, it is possible to couple sheet piles to each other, whereby two sheet piles arranged in a common sheet piling line while the third sheet pile extends at an angle of 90° relative to the other two sheet piles.

In an alternative basic form of the profiled connection profile, where the end of the stop of the one hooked strip merges with the outside of the other hooked strip at the transition of its lock base and stop, the further hook strip, in contrast, is formed in one piece with the transition of its lock base into the stop at the free end of the stop of the hooked strip into which the Larssen sheet pile, which extends at an angle of 90° relative to the further hooked strip, is to be hung. The further hooked strip delimits therein the lock jaw of the hooked strip with the outside of its lock base.

To ensure that the lock profile does not inadvertently become detached from the hooked strip, it is further proposed to provide for forming an elevation or thickening onto the free end of the straight stop, which is raised in the direction of the hooked section. Though only minimally, the elevation or thickening reduces the size of the lock jaw, whereby any escaping of the lock profile of the Larssen sheet pile is effectively prevented. With a wall strength of the hooked strip measuring 7 to 10 mm, the elevation or thickening is up to 2 to 3 mm thick and extends in the shape of a nose inward in the direction of the lock jaw.

The identically shaped hooked strips of the profiled connection section according to the invention preferably include a hooked section that is configured as arc-shaped, preferably substantially in the shape of a semi-circle. To facilitate hanging sheet piles by different manufacturers, experiments have shown that the inside radius of the hooked section is preferably in a range between 9 and 11 mm, whereby the lock chamber has a diameter of 18 to 22 mm and extends over an angular range of 160 to 200°, preferably 180°.

The rectilinear lock floor that immediately adjoins the hooked section is preferably 8 to 12 mm long, preferably 10 mm, and merges directly with the stop.

The inside radius of the stop that preferably corresponds to the inside radius of the arc-shaped hooked section is in a range of 9 to 11 mm.

Depending on the modulus of resistance, the hooked strip preferably has a wall strength measuring 7 to 10 mm, particularly preferred a wall strength measuring 8 to 9 mm.

To achieve an optimal arrangement of the Larssen sheet piles relative to each other, experiments have shown that the hooked strips on the profiled connection section are to be configured and arranged relative to each other in such a manner that the distance of the anchor point, normal to the main direction of the respective Larssen sheet pile, is in a range measuring 30 to 50 mm, preferably in a range measuring 35 up to 35 mm, particularly preferred 40 mm.

To compensate for measured deviations of the sheet piles, when the sheet piles originate, for example, from different manufacturers, and to ensure that the sheet piles can avoid, for example, obstacles in the ground, such as rocks, it is further proposed to configure the hooked strips in such a manner that, when viewed in a cross-sectional direction of the profiled connection section, they allow for deflective motion of the sheet piles without the risk that a given sheet pile may become inadvertently uncoupled. Accordingly, the hooked strips are preferably configured in such a way that they allow for maximally possible deflective motion of Larssen sheet piles from its main direction to ±20°, preferably up to ±25°. The ±symbol denotes therein that the Larssen sheet pile can be deflected clockwise or counterclockwise by 20° and/or 25° from the ideal assembly position as defined by the main direction of the Larssen sheet pile.

On the basis of five embodiments and in reference to the drawings, the invention will be described in further detail below. Show are as follows.

Figure 6:
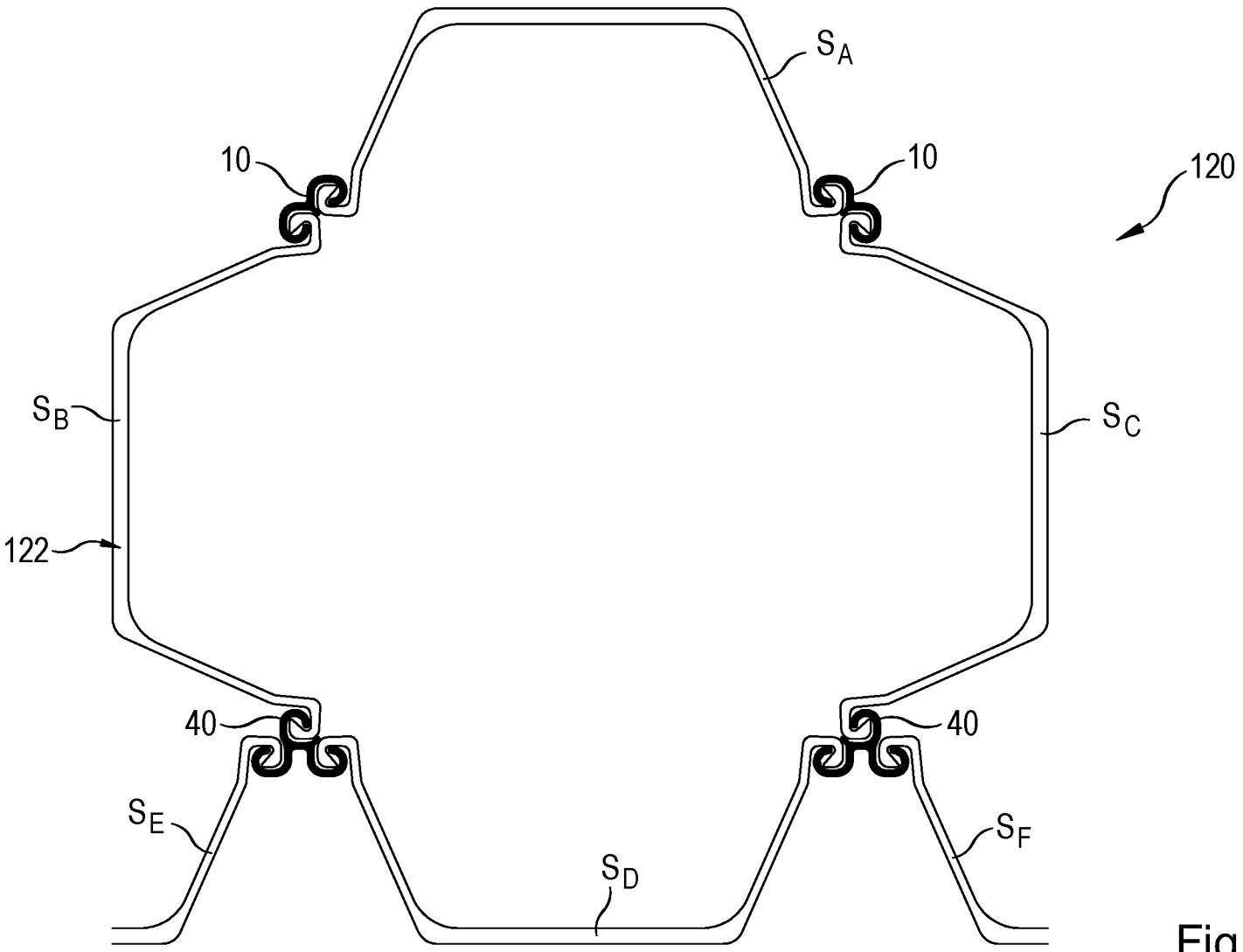
Figure 7:
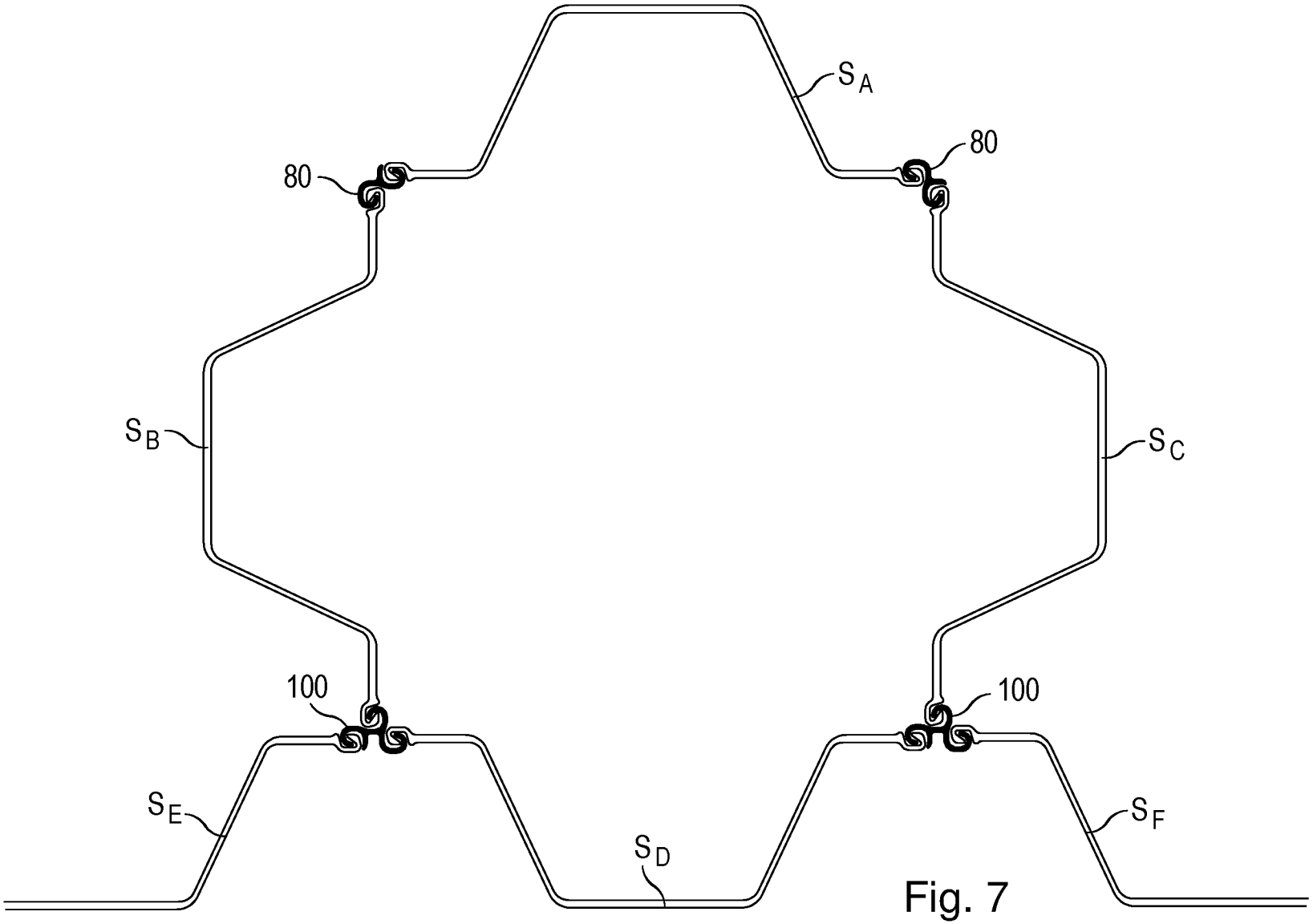

FIG. 6 is a top view of a first implementation of a sheet pile box arrangement using two profiled connection sections according to the first embodiment and two profiled connection sections according to the third embodiment; and FIG. 7 is a top view of a second implementation of a sheet pile box arrangement using two profiled connection sections according to the first embodiment and two profiled connection sections according to the third embodiment.

Figure 1:
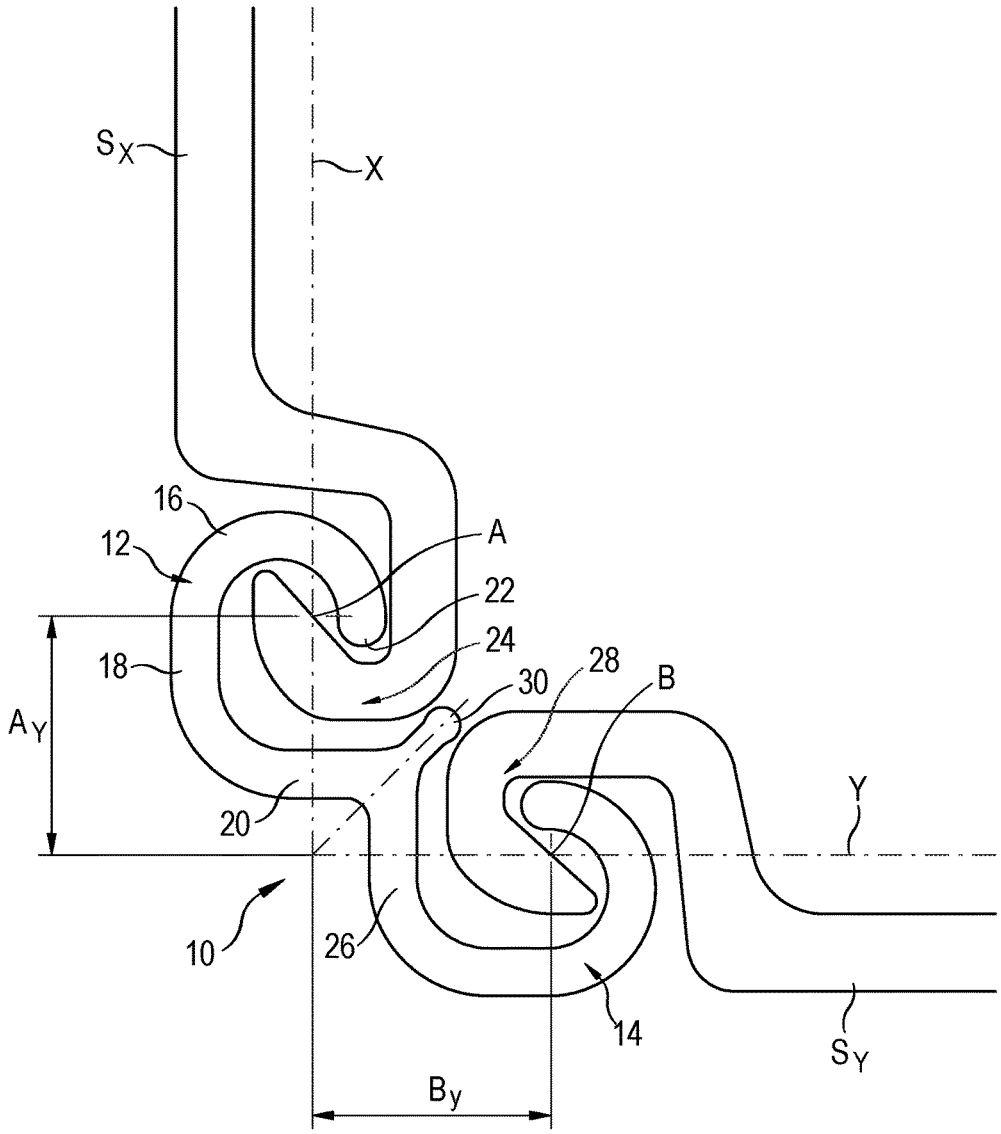
FIG. 1 is a top view of a first embodiment of a profiled connection section according to the invention for connecting two Larssen sheet piles.

FIG. 1 shows a top view of a first embodiment of a profiled connection section according to the invention 10 with a constant cross-section serving for hanging the lock profiles of two Larssen sheet piles Sx and $S_Y$ at an angle of 90°, as indicated by the main directions, marked as X and Y, of the two Larssen sheet piles Sx and $S_Y$.

The profiled connection section 10 has two identically configured hooked strips 12 and 14; the first hooked strip 12, shown below on the left in FIG. 1, where the sheet pile Sx is hung by its lock profile, will be described in further detail.

The first hooked strip 12, with a continuous wall strength measuring 8 mm, has a semi-circularly shaped hooked section 16 that extends over an angle of 180° and has an inside diameter of 20 mm. The hooked section 16 merges into a lock base 18 that extends in a straight manner and has a length of about 10 mm. At a radius of 12 mm, the lock base 18 itself merges into a straight stop 20. The free end 22 of the first hooked strip 12 is pointed to the stop 20 and forms together with said stop the lock jaw 24.

The second hooked strip 14 has a mirror-symmetrical configuration relative to the first hooked strip 12 and merges via the end of its stop 26 with the end of the stop 20 of the first hooked strip 12. A support strip 30 projects, centered in front of the two stops 20 and 26, from between the two lock jaws 24 and 28, which face each other, and is configured as extending symmetrically between the two hooked strips 12 and 14.

FIG. 1 further shows that the two Larssen sheet piles Sx and $S_Y$ extend at an angle of 90° relative to each other in their main directions X and Y. Each hooked strip 12 and 14 therein, when viewed in a cross-sectional direction, has an imaginary anchor point A and/or B where the main contact point of the lock profile of the sheet pile Sx and/or $S_Y$ is arranged in an ideal assembly position.

According to the invention, the anchor point A and/or the anchor point B of the respective hooked strip 12 and/or 14 of the profiled connection section 10 is arranged in such a manner that the anchor point A has a specified distance Ay, normal to the main direction Y of the Larssen sheet pile $S_Y$ hung on the second hooked strip 14, while the anchor point B has a specified distance Bx, normal to the main direction X of the Larssen sheet pile Sx hung on the first hooked strip 12. According to the invention, the two distances Ay and Bx are selected as being identical to ensure that the Larssen sheet piles Sx and $S_Y$ are each located in a defined and specified position in relation to each other when they are in the hung state.

Figure 2:
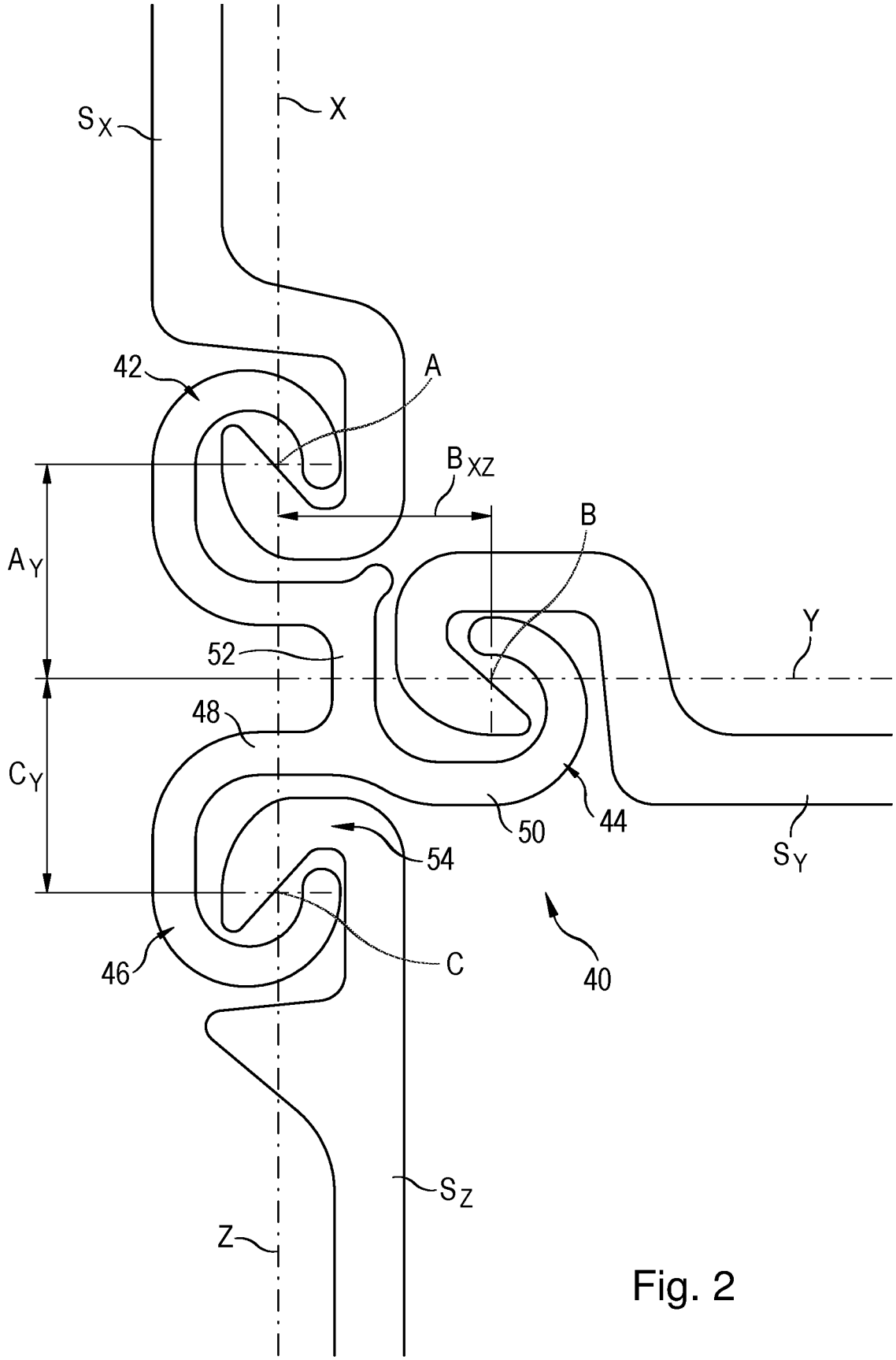
FIG. 2 is a top view of a second embodiment of a profiled connection section according to the invention that is based on the basic form of the first embodiment and serves for connecting three Larssen sheet piles.

FIG. 2 shows a second embodiment of a profiled connection section 40 according to the invention that is based on the basic form of the profiled connection section 10 from the first embodiment and serves for connecting three Larssen sheet piles Sx, $S_Y$ and Sz.

The profiled connection section 40 has a basic form that provides, as described earlier, two hooked strips 42 and 44 that correspond to the hooked strips 12 and 14 from the first embodiment.

A third hooked strip 46 is moreover provided having a structure that corresponds to the structure of the two other hooked strips 42 and 44. With the end of its stop 48, the third hooked strip 46 is formed in one pieced with the outside of the second hooked strip 44 into which the Larssen sheet pile $S_Y$ that extends at an angle of 90° is hung, particularly at the location of the transition of the lock base 50 of the second hooked strip 44 into the stop 52 thereof. Accordingly, the second hooked strip 44 delimits the lock jaw 54 of the third hooked strip 46 via the merging of the lock base 50 into the stop 52.

As in FIG. 1, in FIG. 2 as well, the two Larssen sheet piles Sx and $S_Y$ extend in their main directions X and Y at an angle of 90° relative to each other. Here too, each hooked strip 42 and 44 therein, when viewed in a cross-sectional direction, has an imaginary anchor point A and/or B where the main contact point of the lock profile of the sheet pile Sx and/or $S_Y$ is arranged in an ideal assembly position.

Moreover, the third hooked strip 46 is also configured in such a manner that the third Larssen sheet pile Sz, which extends in the main direction Z, is also arranged by its lock profile at an imaginary anchor point, namely anchor point C. The Larssen sheet pile Sz is therein aligned by its main direction Z relative to the main direction X of the other sheet pile Sx.

As FIG. 2 further shows that the anchor point B is arranged at a distance Bxz normal to the main direction X of the sheet pile Sx and simultaneously normal to the main direction Z of the sheet pile Sz, while the anchor point A is arranged at a distance Ay normal to the main direction Y of the sheet pile $S_Y$, and the anchor point C at a distance $C_Y$ normal to the main direction Y of the sheet pile $S_Y$. The distances Ay, Bxz and Cy are identical in this instance as well.

Figure 3:
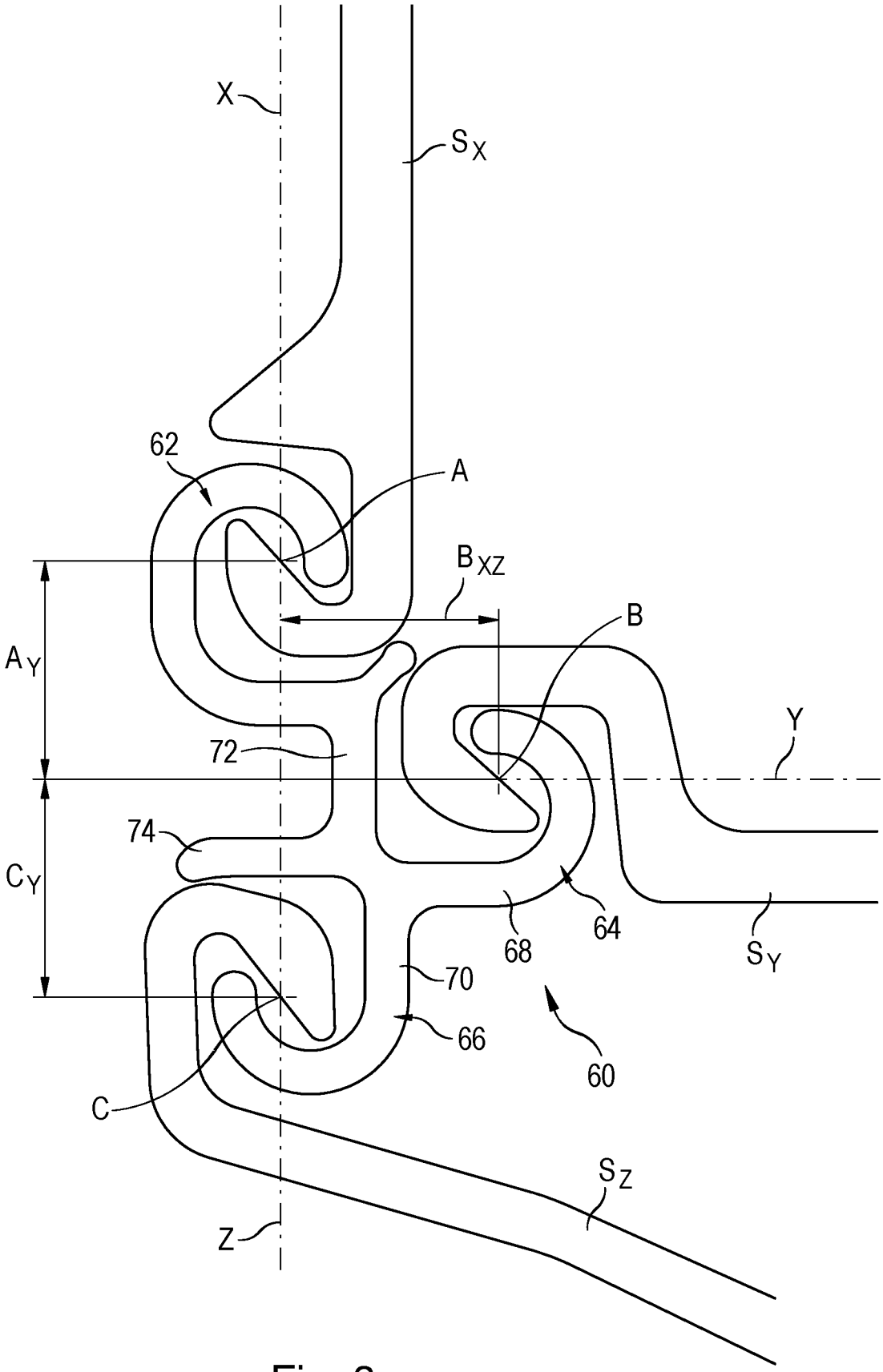
FIG. 3 is a top view of a third embodiment of a profiled connection section according to the invention that is also based on the basic form of the first embodiment and serves for connecting three Larssen sheet piles.

FIG. 3 shows a third embodiment of a profiled connection section 60 according to the invention that also serves for coupling three Larssen sheet piles Sx, $S_Y$, Sz along three main directions X, Y and Z.

The profiled connection section 60 is also based on the basic form of the profiled connection section 10 from the first embodiment and, for connecting three Larssen sheet piles Sx, $S_Y$, Sz, it includes three hooked strips 62, 64 and 66, wherein the two hooked strips 62 and 64 correspond to the hooked strips 12 and 14 from the first embodiment.

In this profiled connection section 60, the third hooked strip 66 is provided with its outside adjoining the outside of the second hooked strip 64 where the Larssen sheet pile $S_Y$ is hung at an angle of 90°, wherein the two hooked strips 64 and 66 merge at the transitions of their lock base 68 and/or 70 with the stops 72 and/or 74 in such a manner that the hooked sections 76 and 78 of the two hooked strips 64 and 66 extend mirror-symmetrically relative to each other.

This embodiment also provides that the third hooked strip 66 is configured in such a manner that the third Larssen sheet pile Sz, which extends in the main direction Z, is also arranged by its lock profile at an imaginary anchor point C. The Larssen sheet pile Sz is therein aligned, by its main direction Z, with the main direction X of the other Larssen sheet pile Sx that is hung on the first hooked strip 62; but, relative to the sheet pile Sx that is hung in the first hooked strip 62, it is hung facing to the outside with its lock profile.

As FIG. 3 further shows that, in this embodiment as well, the anchor point B is arranged at a distance Bxz relative to the main direction X of the Larssen sheet pile Sx and simultaneously to the main direction Z of the Larssen sheet pile Sz, while the anchor point A is arranged at a distance Ay relative to the main direction Y of the Larssen sheet pile $S_Y$, and the anchor point C is arranged at a distance Cy relative to the main direction Y of the Larssen sheet pile $S_Y$. The distances $A_Y$, Bxz and $C_Y$ are identical in this instance as well.

Figure 4:
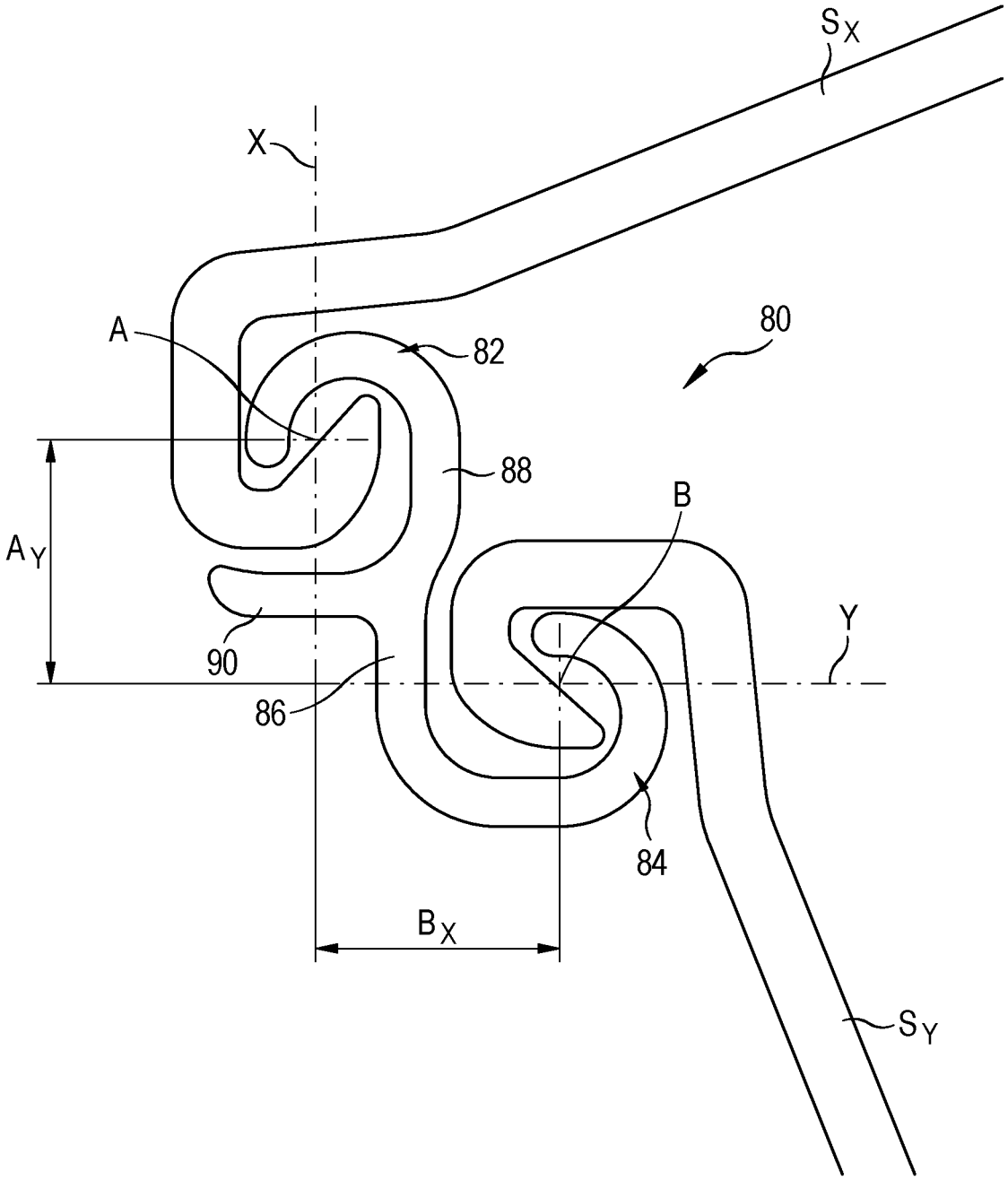
FIG. 4 is a top view of a fourth embodiment of a profiled connection section according to the invention for connecting two Larssen sheet piles.

FIG. 4 shows a fourth embodiment of a profiled connection section 80 for connecting two sheet piles Sx and $S_Y$.

This profiled connection section 80 also provides for two hooked strips 82 and 84 that correspond, in terms of their configuration, to the hooked strip 12. However, with the end of its stop 86, the second hooked strip 84 on this profiled connection section 80 merges by the outside of the first hooked strip 82 at the transition of the lock base 88 with the stop 90 of the first hooked strip 82. The lock jaw 92 of the second hooked strip 84 therein is arranged as being adjacent to the outside of the lock base 88 of the first hooked strip 82, and the stop 90 of the first hooked strip 82 juts out at a right angle at the transition of the stop 86 of the second hooked strip 84 to the first hooked strip 82.

As with the first profiled connection section 10, on this profiled connection section 80 as well, the anchor point A and/or the anchor point B of the respective hooked strip 82 and/or 84 is/are arranged in such a manner that the anchor point A has a specified distance Ay normal to the main direction Y of the Larssen sheet pile $S_Y$ hung on the second hooked strip 84, while the anchor point B has a specified distance Bx normal to the main direction X of the Larssen sheet pile Sx hung on the first hooked strip 82. According to the invention, the two distances Ay and Bx are selected as being identical to ensure that the Larssen sheet piles Sx and $S_Y$ are each located in a defined and specified position in relation to each other when they are in the hung state.

Figure 5:
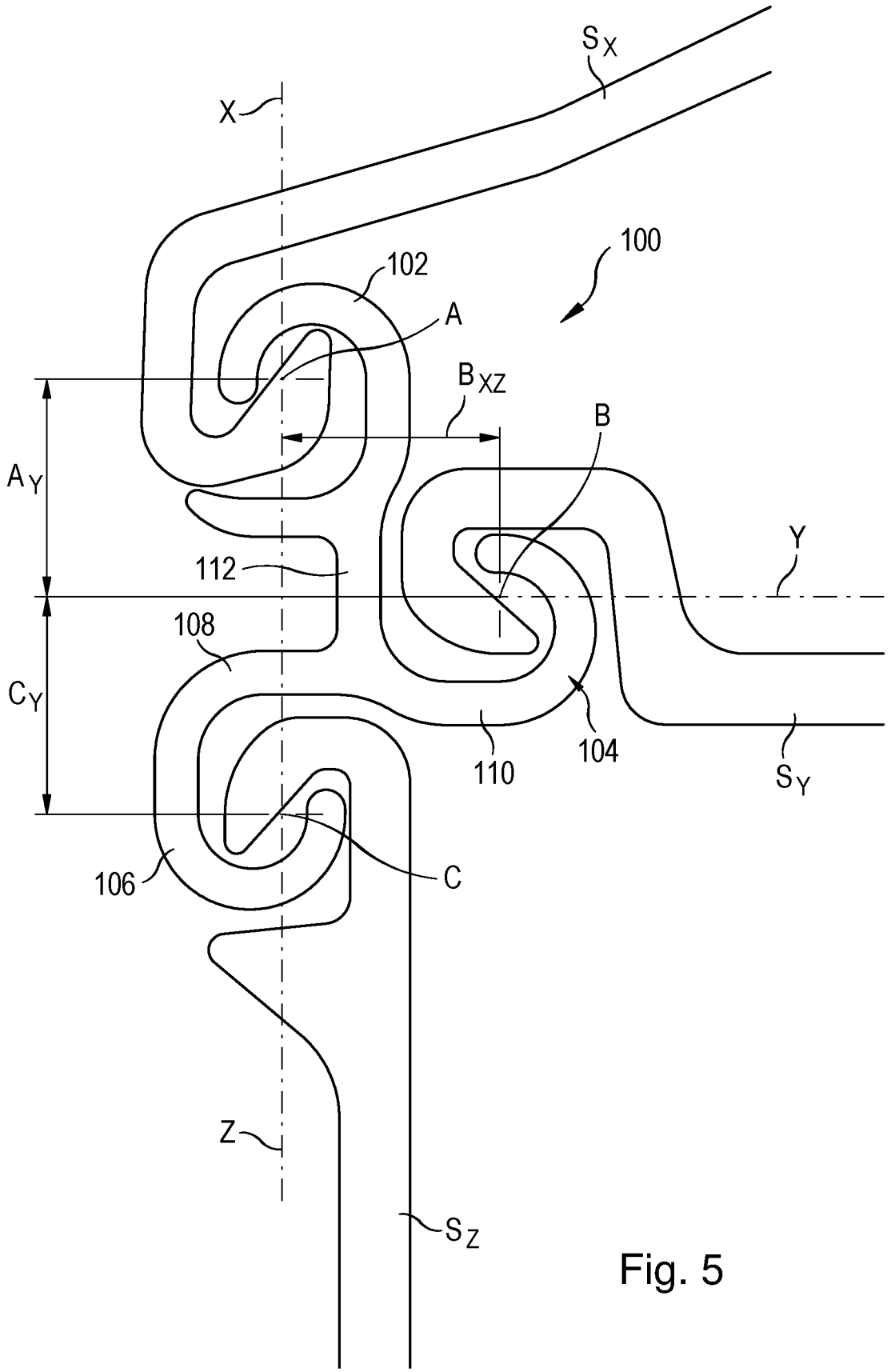
FIG. 5 is a top view of a fifth embodiment of a profiled connection section according to the invention that is based on the basic form of the fourth embodiment and serves for connecting three Larssen sheet piles.

FIG. 5 shows a fifth embodiment of a profiled connection section 100 for connecting three sheet piles Sx, $S_Y$ and Sz.

The profiled connection section 100 is based on the fourth embodiment and has a total of three hooked strips 102, 104 and 106. The two hooked strips 102 and 104 are implemented corresponding to the basic form as shown in FIG. 4.

The third hooked strip 106 mergers via the end of its stop 108 with the transition of the lock base 110 in the stop 112 of the second hooked strip 104, where the Larssen sheet pile $S_Y$ is hung, which extends at an angle of 90° relative to the first hooked strip 102 and the third hooked strip 106.

As in the previous embodiments that have been described in reference to FIGS. 2 and 3, in this fifth embodiment, the anchor point B is arranged at a distance Bxz relative to the main direction Y of the Larssen sheet pile Sx and simultaneously to the main direction Z of the Larssen sheet pile Sz, while the anchor point A is arranged at a distance Ay relative to the main direction Y of the Larssen sheet pile $S_Y$, and the anchor point C is arranged at a distance $C_Y$ relative to the main direction Y of the Larssen sheet pile $S_Y$. The distances $A_Y$, Bxz and $C_Y$ are identical in this instance as well.

The last two figures—FIGS. 6 and 7—show arrangements of sheet piles 12 that are have been coupled to each other to form the so-called sheet pile boxes by using profiled connection sections according to the invention.

The arrangement 120, as seen in FIG. 6, couples a total of four Larssen sheet piles $S_A$ to $S_D$, thereby creating a cross-shaped sheet pile box 122, wherein the sheet pile box 122 is laterally supported by two further Larssen sheet piles $S_E$ and $S_F$.

To this end, the centered Larssen sheet pile $S_A$ shown above is a so-called U-shaped sheet pile that is lowered into the ground with its lock profiles pointing outward. The adjacent Larssen sheet piles $S_B$ and $S_C$ are lowered into the ground rotated clockwise and/or counterclockwise by 90° and connected, with the aid of two profiled connection sections 10, to the Larssen sheet pile $S_A$ arranged in the center.

A further Larssen sheet pile $S_D$ is shown in the middle, bottom that are coupled, with the aid of two profiled connection sections 40 as shown in FIG. 2, with the Larssen sheet piles $S_B$ and $S_C$, which are rotated by 90°, forming the sheet pile box 122. To further support the sheet pile box 122, the two further Larsen pile sheets $S_E$ and SF are hung in the two profiled connection profiles 40.

It is remarkable about the arrangement 120, as shown in FIG. 6, that the totality of the Larssen sheet plies $S_A$ through $S_F$ are coupled to each other symmetrically and without any force.

FIG. 7 shows a further arrangement 130 where the Larssen sheet piles $S_A$ through $S_F$ are coupled to each other using the profiled connection sections 80 and 100, as shown and described in FIGS. 4 and 5.

LIST OF REFERENCE SIGNS

10 Profiled connection section
Sx Larssen sheet pile
$S_Y$ Larssen sheet pile
X Main direction of the Larssen sheet pile Sx
Y Main direction of the Larssen sheet pile $S_Y$
12 First hooked strip
14 First hooked strip
16 Hooked section
18 Lock base
20 Stop
22 Free end
24 Lock jaw
26 Stop
28 Lock jaw
30 Support strip
A Anchor point
B Anchor point
$A_Y$ Distance to the main direction Y
Bx Distance to the main direction X
40 Profiled connection section
Sx Larssen sheet pile
$S_Y$ Larssen sheet pile
Sz Larssen sheet pile
42 First hooked strip
44 First hooked strip
46 First hooked strip
48 Stop
50 Lock base
52 Stop
54 Lock jaw
A Anchor point
B Anchor point
C Anchor point
$A_Y$ Distance to the main direction Y
Bxz Distance to the main directions X and Z
$C_Y$ Distance to the main direction Y
60 Profiled connection section
Sx Larssen sheet pile
$S_Y$ Larssen sheet pile
Sz Larssen sheet pile
62 First hooked strip
64 First hooked strip
66 First hooked strip
68 Lock base
70 Lock base
72 Stop
74 Stop
76 Hooked section
78 Hooked section
A Anchor point
B Anchor point
C Anchor point
$A_Y$ Distance to the main direction Y
Bxz Distance to the main directions X and Z
$C_Y$ Distance to the main direction Y
80 Profiled connection section
Sx Larssen sheet pile
$S_Y$ Larssen sheet pile
82 First hooked strip
84 First hooked strip
86 Stop
88 Lock base
90 Stop
92 Lock jaw
A Anchor point
B Anchor point
$A_Y$ Distance to the main direction Y
Bx Distance to the main direction X
100 Profiled connection section Sx Larssen sheet pile
$S_Y$ Larssen sheet pile
Sz Larssen sheet pile
102 First hooked strips
104 Second hooked strips
106 Third hooked strips
108 Stop
110 Lock base
112 Stop
A Anchor point
B Anchor point
C Anchor point
$A_Y$ Distance to the main direction Y
Bxz Distance to main directions X and Z
$C_Y$ Distance to main direction Y
120 Arrangement
$S_A$ Larssen sheet pile
$S_B$ Larssen sheet pile
$S_C$ Larssen sheet pile
$S_D$ Larssen sheet pile
$S_E$ Larssen sheet pile
$S_F$ Larssen sheet pile
122 Larssen sheet pile
130 Arrangement
$S_A$ Larssen sheet pile
$S_B$ Larssen sheet pile
$S_C$ Larssen sheet pile
$S_D$ Larssen sheet pile
$S_E$ Larssen sheet pile
$S_F$ Larssen sheet pile

The invention claimed is:

1. A profiled connection section with a constant cross-section for coupling at least two Larssen sheet piles at an angle of 90°, comprising two identically configured hooked strips, wherein each hooked strip has a hook-shaped hook section, a lock base, which adjoins one end of the hook section and extends in a straight manner, and a stop, which adjoins the lock base, wherein the free end of the hook section together with the stop form a lock jaw for hanging the sheet pile lock of the Larssen sheet pile, and wherein, when viewed in a cross-sectional direction, each hooked strip has an imaginary anchor point defined on an inside surface of the hooked strip on which the main contact point of the lock profile of the sheet pile is arranged, when it is in an ideal assembly position, wherein:

the anchor point of each hooked strip has a specified distance normal to the main direction of the Larssen sheet pile hung on the respectively other hooked strips in the ideal assembly position, the distances between the anchor points normal to the main direction of the Larssen sheet piles hung in the hooked strips in the ideal assembly position are identical, a first plane that includes an outside straight surface of the lock base and a second plane that includes an outside straight surface of the stop of each hooked strip are perpendicular, wherein the outside surfaces are spaced apart from the inside surface of the hooked strip, and the second planes that include the surfaces of the stops of adjacent hooked strips are perpendicular.

2. The profiled connection section according to claim 1, wherein the two hooked strips extend mirror-symmetrically relative to each other and are connected to each other by the ends of their stops, and wherein a support strip is provided between the lock jaws facing each other, which extends centered between the two lock jaws and is directed outward starting from the connection area between stops.

3. The profiled connection section according to claim 1, wherein the end of the stop of the one hooked strip merges with the outside of the other hooked strip at its transition of its lock base with its stop, wherein the lock jaw of the one hooked strip is arranged adjacent relative to the outside of the lock base of the other hooked strip, and wherein the stop of the other hooked strip juts out at a right angle from the transition of the stop of the one hooked strip to the other hooked strip and protrudes, viewed in cross-sectional direction, beyond to the end of the hooked section arranged opposite.

4. The profiled connection section according to claim 1, wherein a further hooked strip identically configured as the other two hooked strips is provided, which serves for hanging a third Larssen sheet pile whose main direction extends at an angle of 90° relative to one of the two other Larssen sheet piles in the ideal assembly position, and whose anchor point has a distance normal to the Larssen sheet pile extending at an angle of 90°, which corresponds to the two other distances.

5. The profiled connection section according to claim 4, wherein the further hooked strip is provided with the end of its stop on the outside of the hooked strip, where the Larssen sheet pile that extends at an angle of 90° is to be hung, at the transition of its lock base and its stop in such a manner that the transition delimits the lock jaw of the further hooked strip.

6. The profiled connection section according to claim 4, wherein the further hooked strip is provided with its outside on the outside of the hooked strip, where the Larssen sheet pile that extends at an angle of 90° is to be hung, wherein the two hooked strips merge at their transitions of their lock bases with their stops in such a manner that the two hooked strips extend mirror-symmetrically by their hooked sections and their lock bases.

7. A profiled connection section according to claim 4, wherein the further hooked strip is formed in one piece with its transition of its lock base with its stop on the free end of the stop of the hooked strip where the Larssen sheet pile extending at an angle of 90° opposite the further hooked strip is to be hung, wherein the further hooked strip delimits by the outside of its lock base the lock jaw of the other hooked strip.

8. The profiled connection section according to claim 1, wherein a thickening is formed on the free end of the straight stop that is raised in the direction of the hooked section.

9. The profiled connection section according to claim 1, wherein each hooked strip is formed as arc-shaped, preferably substantially in the shape of a semi-circle, and wherein the hooked strip has an internal radius in a range from 9 to 11 mm that extends over an angle range from 160 to 200°, preferably corresponding to 180°.

10. The profiled connection section according to claim 9, wherein the transition of the lock base with the stop has an internal radius that is in a range between 9 and 11 mm and that preferably corresponds to the internal radius of the arc-shaped hooked strip.

11. The profiled connection section according to claim 1, wherein each the hooked strips have a wall strength that measures 7 to 10 mm, preferably 8 to 9 mm.

12. The profiled connection section according to claim 1, wherein each distance of the anchor point is normal to the main direction of the Larssen sheet pile and in a range between 30 and 50 mm, preferably in a range between 35 and 35 mm, and preferably corresponding to 40 mm.

13. The profiled connection section according to claim 1, wherein the maximally possible deflection of the Larssen sheet pile from its main direction is up to ±20°, preferably up to ±25°.

* * * * *